US010799732B2

(12) United States Patent
Bouquier et al.

(10) Patent No.: US 10,799,732 B2
(45) Date of Patent: Oct. 13, 2020

(54) HARNESS

(71) Applicant: ZEDEL, Crolles (FR)

(72) Inventors: Benoît Bouquier, Corenc (FR); Simon Emonin, Grenoble (FR)

(73) Assignee: ZEDEL, Crolles (FR)

( * ) Notice: Subject to any disclaimer, the term of this patent is extended or adjusted under 35 U.S.C. 154(b) by 13 days.

(21) Appl. No.: 15/919,844

(22) Filed: Mar. 13, 2018

(65) Prior Publication Data

US 2018/0345053 A1 Dec. 6, 2018

(30) Foreign Application Priority Data

Mar. 13, 2017 (FR) ..... 17 52048

(51) Int. Cl.
*A62B 35/00* (2006.01)

(52) U.S. Cl.
CPC ..... *A62B 35/0037* (2013.01); *A62B 35/0006* (2013.01); *A62B 35/0018* (2013.01); *A62B 35/0025* (2013.01); *A62B 35/0031* (2013.01)

(58) Field of Classification Search
CPC ..... A62B 35/0037; A62B 35/0012; A62B 35/0025
See application file for complete search history.

(56) References Cited

U.S. PATENT DOCUMENTS 3,526,431 A * 9/1970 Curran ..... B60R 22/3405 297/479
4,553,633 A 11/1985 Armstrong et al.
5,036,548 A * 8/1991 Grilliot ..... A62B 17/003 182/3
8,235,173 B2 * 8/2012 Kopp ..... A45F 3/14 182/3
8,938,864 B2 * 1/2015 Casebolt ..... A62B 35/0037 24/573.11
9,435,484 B1 * 9/2016 Yang ..... F16B 45/04
2010/0300802 A1 12/2010 Kopp
2017/0120087 A1 * 5/2017 Cowell ..... A62B 35/0006
2017/0216635 A1 * 8/2017 Stibilj ..... A62B 35/0018

FOREIGN PATENT DOCUMENTS

EP 1852145 A1 11/2007
FR 2 945 221 A1 11/2010

* cited by examiner

*Primary Examiner* — Alvin C Chin-Shue
(74) *Attorney, Agent, or Firm* — Oliff PLC

(57) ABSTRACT

The roping harness comprises a pair of leg loops and a suspension point. The suspension point comprises:

distinct first and second rings, a connecting part fixed continuously to the two distinct rings, the connecting part mechanically connecting the two distinct rings with the pair of leg loops, a closed metal connector provided with a rod.

The two rings are separated from one another by a first distance in a first direction and define an empty space between a first lateral surface of the first ring and a second lateral surface of the second ring. The two rings are arranged so as to allow fitting of the rod of the connector in the two rings. The rod presents a longitudinal axis coinciding with the first direction. The rod is fitted movable in rotation in the two rings and the connector is mounted movable in rotation around the rod.

27 Claims, 11 Drawing Sheets

HARNESS

BACKGROUND OF THE INVENTION

The invention relates to a harness comprising a connector configured to enable attachment of an external item.

STATE OF THE ART

In the field of rock climbing, mountain climbing, ski-mountaineering, or for working at heights, the harness is an indispensable equipment item which ensures user safety by attaching him to an anchoring point. This anchoring point can be a directional point or a fixed point.

Depending on the uses and the associated standards in force, the harness presents different forms. It is possible to find sit harnesses or harnesses which further comprise shoulder straps. The harness can also comprise a single attachment point or on the contrary several attachment points.

Different harness configurations are known. A climbing harness generally has a textile ring connecting the waist belt with the leg loops. This textile ring acts as attachment point for tools or equipment, i.e. for the gear required for performing rock climbing for example. It is also known to fix the leg loops to the waist belt by means of a strap and to form a strap loop on the belt of the harness. In both these configurations, an equipment item such as a metal connector is fitted in the textile loop in order to be able to use for example a lanyard, an ascender or a descender.

As an alternative, for a caving harness or for a harness for working at heights, it is commonplace to have a harness which can be completely opened. The belt of the harness is provided with two loops which are located at each end of the belt. The two loops are secured to one another, for example by means of a multidirectional semi-round metal connector, in order to close the belt of the harness. The equipment items are attached in the metal connector.

Professional harnesses can use even more complex configurations with for example several loops enabling the harness to be closed. It is possible to find a pair of ventral loops and a pair of sternal (chest) loops. It is also possible to find closing means of the belt and adjustment means of the belt which are different from the pairs of loops and which do not enable items of equipment to be attached. For example, the closing means are formed by fast-on loop attachments.

Here again, textile loops are used to secure a metal connector to the harness.

In conventional manner, once the user is suspended in his harness, it is relatively difficult for him to handle the different items of equipment, as the connector is under tension and the equipment is wedged against the user or the equipment items are wedged against one another in the connector.

OBJECT OF THE INVENTION

One object of the invention consists in providing a harness enabling better management of the equipment attached to the harness and in particular inside the connector which is fixed to the harness.

The harness is remarkable in that it comprises:

- a pair of leg loops and a suspension point comprising:
  - distinct first and second rings,
  - a connecting part fixed continuously to the distinct first and second rings, the connecting part mechanically connecting the distinct first and second rings with the pair of leg loops,

- a closed metal connector provided with a rod.

The harness is also remarkable in that:

- the closed metal connector and the connecting part are different of possible closing means of the harness,
- the first and second rings are separated from one another by a first distance in a first direction and define an empty space between a first lateral surface of the first ring and a second lateral surface of the second ring,
- the first and second rings are arranged in such a way as to allow fitting of the rod of the connector in the first and second rings, the rod presenting a longitudinal axis coinciding with the first direction, the rod being fitted movable in rotation in the first and second rings and the connector being fitted movable in rotation around the longitudinal axis of the rod.

In one development, the first and second rings are formed by first and second textile loops and the connecting part is made from textile material.

Is it is advantageous to provide for the first and second textile loops to be sewn onto the connecting part.

In preferential manner, the first and second textile loops are sewn onto the connecting part in first and second fixing positions aligned in the first direction.

Advantageously, a first adapter is fitted inside the first ring. The first adapter comprises a first pass-through hole in the first direction, the rod passing through said first pass-through hole.

In another embodiment, a second adapter is fitted inside the second ring. The second adapter comprises a second pass-through hole in the first direction so that the rod passes through the first and second pass-through holes.

It is further possible to provide for the first adapter and the second adapter to be formed by a single monolithic part configured to allow fitting of a connecting part on the rod in a space situated between the first adapter and the second adapter.

In an alternative embodiment, the monolithic part defines a groove between the first adapter and the second adapter.

In preferential manner, the first adapter and/or the second adapter are made from polymer material.

Advantageously, at least the first pass-through hole of the first adapter presents a cross-section complementary to the cross-section of the rod of the connector.

It is possible to provide a harness comprising a waist belt. The connecting part is fixed to at least a part of the belt and the first and second rings are arranged so that the longitudinal axis of the rod can rotate freely in a direction parallel to the longitudinal axis of the belt.

In another embodiment, the harness comprises a belt and the first ring and second ring are formed by a strap and/or a rope which are fixed directly onto the belt.

Advantageously, the first and second rings are fixed to the ventral portion of the belt covering the user's abdomen to form a ventral suspension point.

In preferential manner, the first and second rings are connected to the belt to form a lateral suspension point.

It is also possible to provide for the connecting part to form at least a part of the belt and for the first and second rings to be arranged so that the longitudinal axis of the rod can rotate freely in a direction perpendicular to the longitudinal axis of the belt.

Preferentially, the harness comprises a belt and adjustment means of the circumference of the belt. The first and second rings are distinct from the adjustment means of the circumference of the belt, and the adjustment means of the circumference of the belt are located outside the surface demarcated by the fixing points of the first ring with the belt and of the second ring with the belt.

Alternatively the harness is not provided with shoulder straps.

In another development, the harness comprises shoulder straps and the first and second rings are connected to the belt without being fixed onto the shoulder straps.

In a particular embodiment, the first ring and/or second ring are formed by a strap and/or a rope which covers two opposite surfaces of the belt.

Advantageously, the harness comprises a belt and opening and closing means of the belt located outside the surface demarcated by the fixing points of the first ring with the belt and of the second ring with the belt.

In another development, the harness comprises shoulder straps and the first and second rings are fixed to form a sternal or dorsal suspension point, the first and/or second rings being formed by at least one strap or rope mechanically connected to at least one shoulder strap.

It is further possible to provide for the first ring to be formed by a first strap and for the second ring to be formed by a second strap different from the first strap.

In a preferential embodiment, the closed metal connector defines a closed contour. The connector is fixed to the belt by means of the first and second rings so as to be able to make the closed contour rotate according to an axis of rotation parallel with or perpendicular to the longitudinal axis of the belt.

Advantageously, the rod of the connector is configured to rotate independently from the rest of the connector.

In an alternative, the rod of the connector is fitted in removable manner so as to enable the connector to be removed from the harness.

In one embodiment, the rod of the connector is configured to accommodate attachment parts of a seat support, said attachment parts being arranged on the rod outside a closed contour of the connector and of the first and second rings.

Preferentially, the first and second rings and the connecting part are formed by a monolithic part made from metal. The monolithic part comprises at least one hole for passage of at least one strap configured to mechanically connect the first and second rings to at least one pair of leg loops. The monolithic part defines a groove.

It is further possible to provide for the monolithic part to be fixed to the belt to form a ventral suspension point, the first direction being parallel to a longitudinal axis of the belt.

In another development, the monolithic part is fixed to the belt to form a lateral suspension point, the first direction being perpendicular to a longitudinal axis of the belt.

Alternatively, the monolithic part is fixed to a pair of shoulder straps to form a sternal or dorsal suspension point, the first direction being perpendicular to a sagittal plane of the harness.

BRIEF DESCRIPTION OF THE DRAWINGS

Other advantages and features will become more clearly apparent from the following description of particular embodiments of the invention given for non-restrictive example purposes only and represented in the appended drawings, in which.

DETAILED DESCRIPTION

Figure 1:
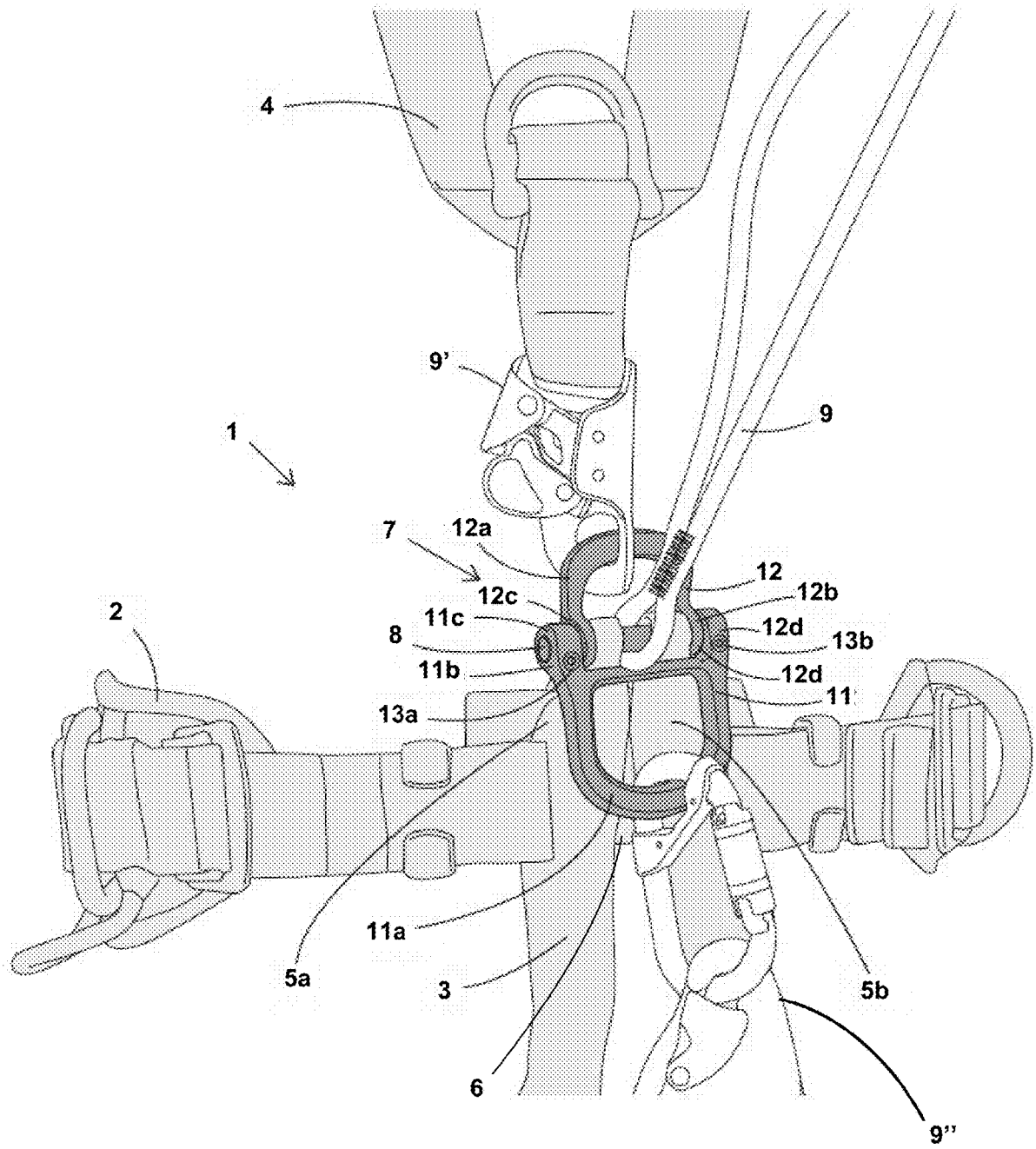
FIG. 1 represents a partial schematic view of a roping harness provided with a ventral suspension point according to a first embodiment of the invention.

As illustrated in FIG. 1, a harness 1 according to the invention comprises at least one suspension point, a pair of leg loops 3 and possibly a belt 2. The harness 1 can be configured to be associated with a pair of shoulder straps 4 fitted in removable or irremovable manner with the belt 2. Depending on the embodiments, the harness comprises a pair of shoulder straps 4 or does not have any shoulder straps.

Figure 8:
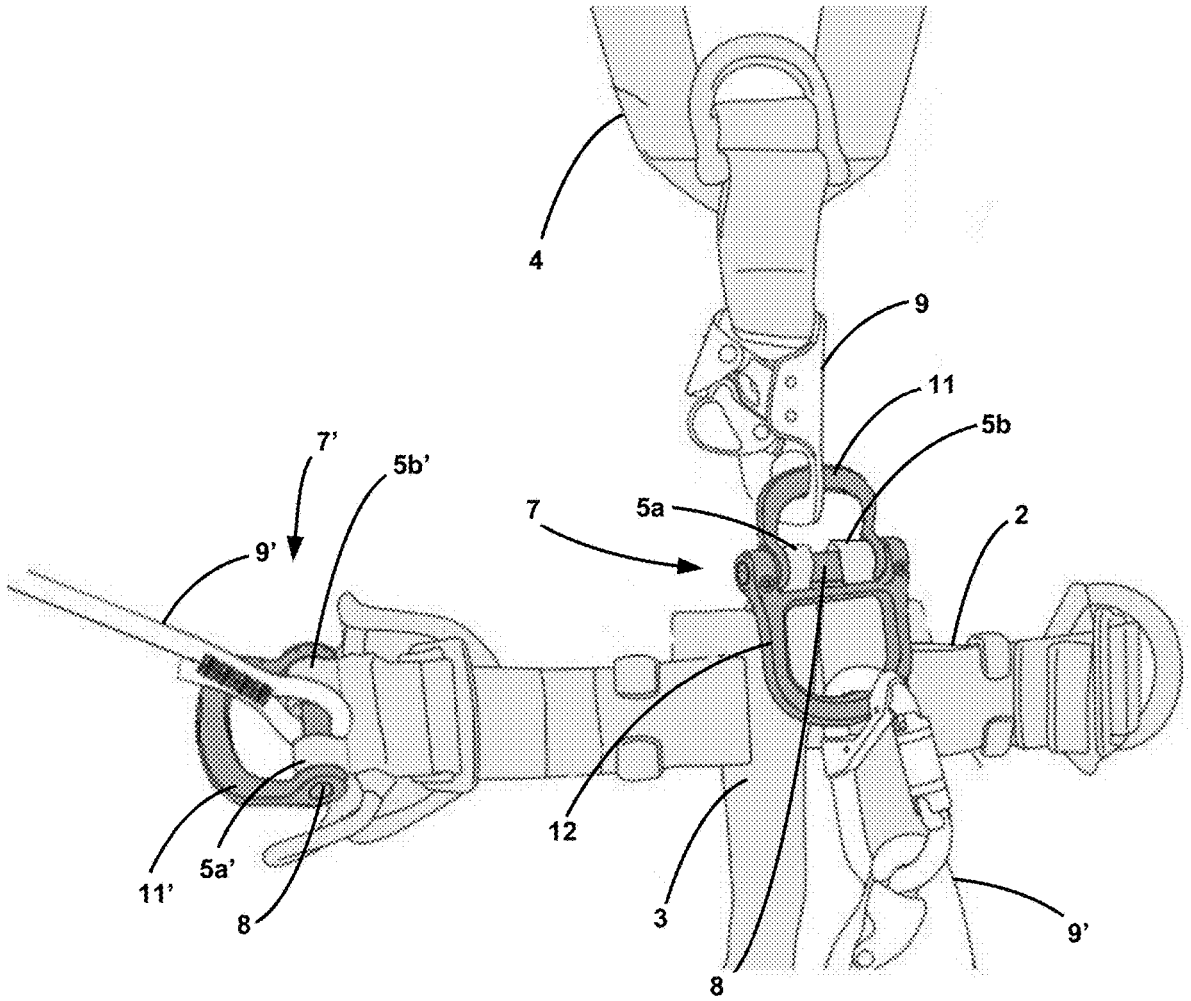
FIG. 8 represents a schematic view of a roping harness provided with a ventral suspension point and with a lateral suspension point according to the invention.
Figure 9:
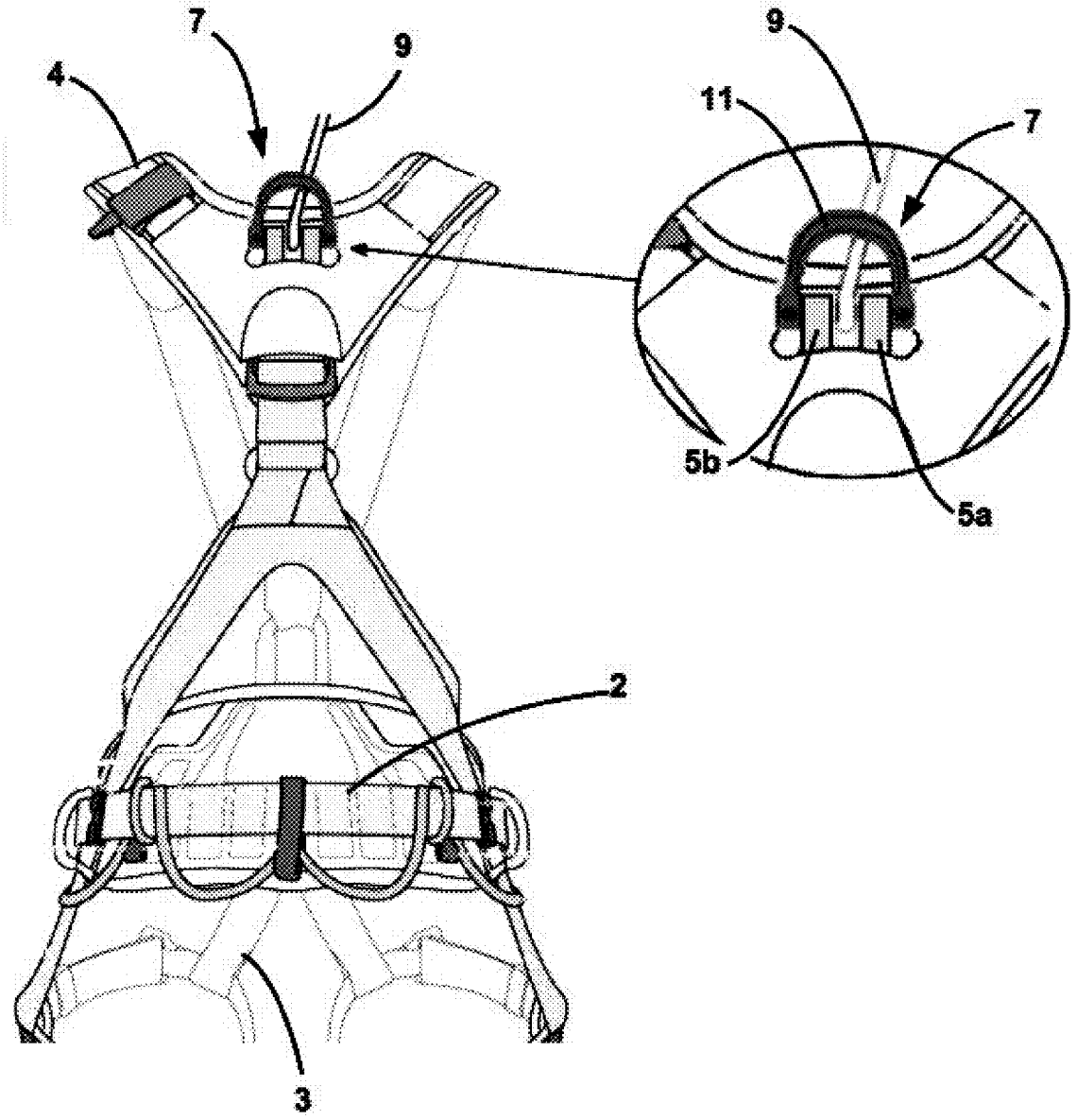
FIG. 9 represents a schematic view of a roping harness provided with a dorsal suspension point according to the invention, FIG. 10 represent a schematic view of a roping harness provided with a sternal suspension point according to the invention.
Figure 10:
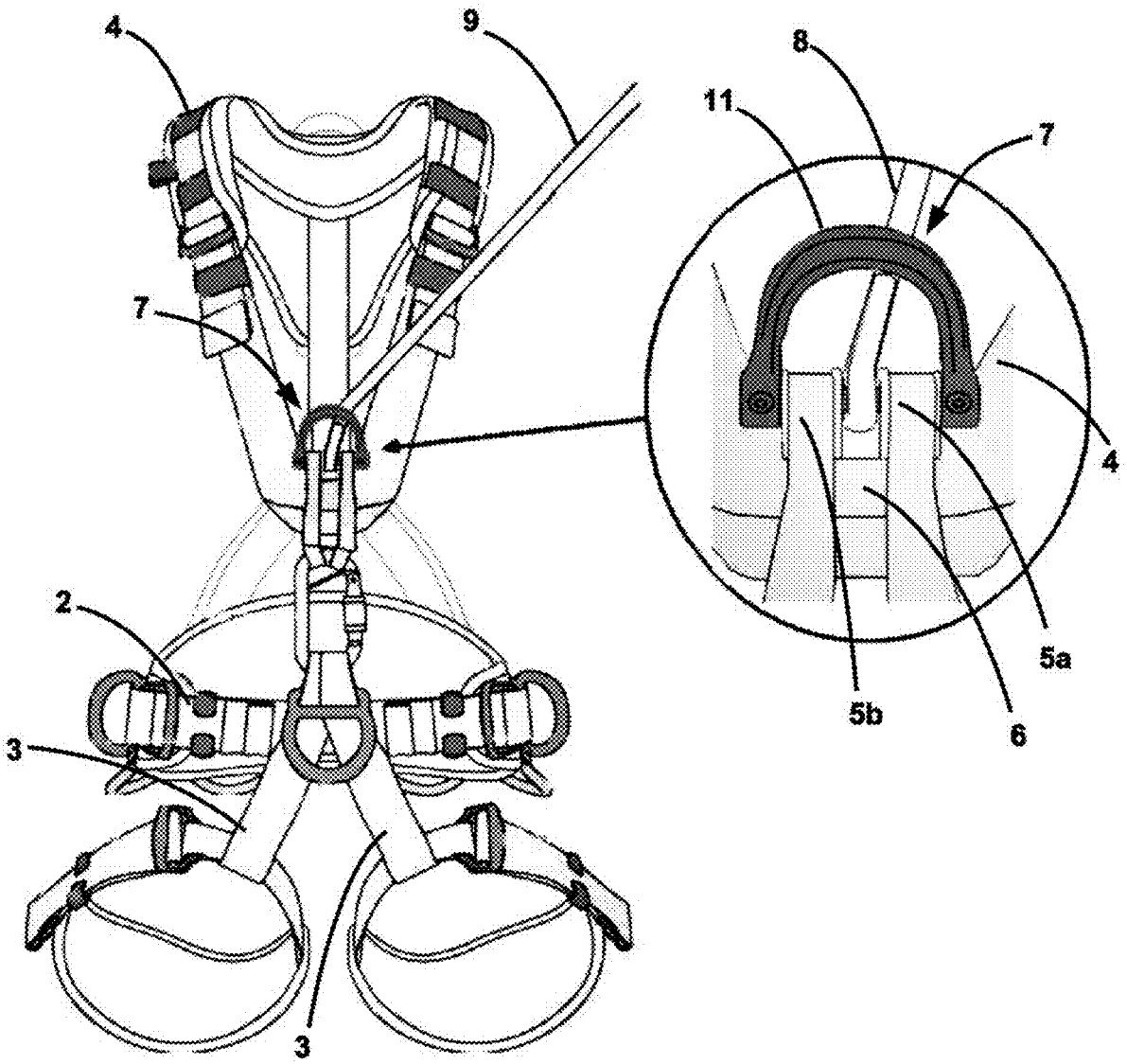

Depending on the embodiments, the suspension point can be a ventral suspension point illustrated in FIGS. 1 to 8, a lateral suspension point illustrated in FIG. 8, a dorsal suspension point illustrated in FIG. 9 or a sternal suspension point illustrated in FIG. 10.

The ventral suspension point and the lateral suspension point are advantageously fixed directly to the belt 2 of the harness 1. The sternal suspension point and the dorsal suspension point are fixed directly to the pair of shoulder straps 4. The harness can comprise one suspension point or several different suspension points. The suspension points can be achieved in different manners on one and the same harness.

The suspension point comprises distinct first and second rings 5*a* and 5*b*. The suspension point also comprises a connecting part 6 fixed continuously to the distinct first and second rings 5*a*/5*b*. The connecting part 6 mechanically connects the distinct first and second rings 5*a* and 5*b* with the pair of leg loops 3. The connecting part 6 provides the mechanical connection between the pair of leg loops 3 and the first and second rings 5*a* and 5*b*. In this way, when the user is suspended in his harness, the user's weight is at least partially supported by the leg loops 3 which are connected to the distinct first and second rings 5*a* and 5*b* by means of the connecting part 6.

The suspension point further comprises a closed connector 7 provided with a rod 8. The connector 7 is advantageously a metal connector. The connector 7 is designed to secure different equipment items 9, 9' and 9" with the harness. In the embodiment illustrated in FIGS. 1 and 2, the different equipment items are separated so as not to come into contact with one another. In the embodiment of FIG. 3, two equipment items 9 and 9' are fitted in one ring of the connector 7.

As indicated in the foregoing, the first and second rings 5*a* and 5*b* are distinct from one another, and more particularly they are separated from one another by a first distance in a first direction. The first and second rings 5*a* and 5*b* advantageously define an empty space between a first lateral surface of the first a ring 5*a* and a second lateral surface of the second ring 5*b*.

The first and second rings 5*a* and 5*b* are configured to allow a connector 7 to be inserted in each of the first and second rings 5*a* and 5*b*. The connector 7 passes through the two rings in order to be secured to the harness under optimum safety conditions. The first and second rings 5*a* and 5*b* are configured so that the connector 7 can move in rotation with respect to the belt 2. The axis of rotation AA is parallel to the first direction or substantially parallel to the first direction. In this way, the connector 7 is securedly attached to the harness and can move in rotation in order to provide good user comfort.

The first and second rings 5*a* and 5*b* are arranged in such a way as to enable the rod 8 of the connector 7 to be fitted in the first and second rings 5*a* and 5*b*. The rod 8 presents a longitudinal axis which coincides with the first direction. The rod 8 is mounted movable in rotation in the first and second rings 5*a* and 5*b* and the connector 7 is mounted movable in rotation around the rod 8. The axis of rotation of the connector 7 is formed by the rod 8. In this way, the suspension point has a connector 7 which can move in rotation inside the first and second rings 5*a* and 5*b*. The rod 8 and connector 7 are mounted movable in rotation around the longitudinal axis of the rod 8. The rod 8 is advantageously a slender part of circular cross-section. Depending on the embodiments, the rod 8 is monolithic with the rest of the connector 7 or it can be removed from the connector 7.

The connecting part 6 which connects the two rings 5*a* and 5*b* enables the two rings to be mechanically connected to one another and to the other components constituting the harness, for example the belt 2 or shoulder straps 4. The connecting part 6 enables the maximum distance separating the two rings in the a first direction to be defined, in particular in the absence of a connector 7 inside the two rings 5*a* and 5*b*. The connecting part 6 also enables movements of the two rings 5*a* and 5*b* with respect to one another in the other directions to be limited.

The connecting part 6 connects the first ring 5*a* continuously with the second ring 5*b* in order to form a mechanical connection parallel to the mechanical connection formed by the connector 7. This mechanical connection prevents the appearance of different sets of the stresses between the two rings 5*a* and 5*b* originating from other components of the harness.

In advantageous manner, the connector 7 is configured so as not to apply simultaneous stresses on the two opposite external surfaces of the two rings 5*a* and 5*b* in the first direction and directed towards the space situated between the two rings 5*a* and 5*b*.

The connector 7 does not play any part in closing of the harness. In this way it is possible to wear the harness 1, open the belt 2 and adjust the circumference of the belt 2 without handling the connector 7. It is also possible to remove the connector 7 without modifying the adjustment of the belt 2 and without opening the harness 1. If the rings 5*a* and 5*b* close the harness, for example by means of a hemispheric connector, the two rings 5*a* and 5*b* are subjected to forces which prevent opening of the harness and which deform the rings. Rotation of the connector 7 is more difficult or even impossible under certain conditions. The axis of rotation of the connector is not formed by the rod but by the opposite side walls of the rings defined in the connector.

The harness 1 also comprises adjustment means of the circumference of the belt 2 which are configured to modify the length of the belt 2 to adjust to the user's morphology. The adjustment means and the closing means of the belt 2 are advantageously dissociated from the connector 7. It is then possible to remove the connector 7 without modifying the adjustment of the belt 2.

In advantageous manner, the connecting part 6 is different from any closing means of the harness which may be provided. When the connecting part 6 forms the closing means of the harness, opening of the harness in fact generally results in removal of the connector 7 which complicates use of the harness.

Depending on the embodiments, the connecting part 6 can be a textile part, for example a strap, a plastic material which can be in the form of a plate, or a metal part which can also be in the form of a plate.

As indicated in the foregoing, the first and second rings 5*a* and 5*b* are advantageously made from textile material or from metallic material. To facilitate manufacture of the connector 7, it is advantageous to form the rings 5*a*/5*b* and connecting part 6 from a textile material or from a metallic material.

In a particular embodiment, the two rings 5*a* and 5*b* and advantageously the connecting part 6 define a pass-through cavity enabling an equipment item 9 to be inserted in the pass-through cavity so that the equipment item 9 passes round the rod 8. The assembly is arranged so that the equipment item 9 can rotate around the rod 8 independently from the connector 7.

This configuration enables independent rotation of the connector 7 with respect to the harness and/or with respect to the equipment item 9 even when the user is suspended in his harness by means of the equipment item 9. The equipment item 9 can also rotate independently from the connector 7 and independently from the harness 1.

Depending on the configurations, the equipment item 9 can be a textile part or a metal part. Other materials are also possible. The equipment item 9 can define a loop in a textile part, a metal loop or an opening in a metal part.

In another embodiment, the two rings 5*a* and 5*b* and connecting part 6 define a pass-through groove allowing access to the rod 8 between the two rings 5*a* and 5*b*. The rod 8 being accessible, it is possible to install an equipment item 9 which passes round the rod 8. The assembly is arranged so that the equipment item 9 can rotate around the rod 8 independently from the connector 7 and from the harness 1. In like manner, the connector 7 can rotate independently from the harness 1 and from the equipment item 9. What is stipulated for the equipment item 9 can also be applied to the additional equipment item 9' or 9".

The two loops 5*a* and 5*b* are dissociated from one another by a space which enables an equipment item 9 to be fixed on the rod 8 of the connector 7 between the two loops 5*a* and 5*b*. The equipment item 9 is not able to move over the whole circumference of the connector 7 as it is blocked by the two loops 5*a* and 5*b*.

This configuration is particularly advantageous as the rod 8 performs the mechanical connection between the harness 1 and an external element, for example a rope or an anchoring point. An equipment item 9 can thus be fixed to the rod 8 without preventing rotation of the equipment item 9 with respect to the connector 7 and without preventing rotation of the equipment item 9 with respect to the harness.

All these configurations enable the user to tension the rod 8 of the connector 7 fitted in the rings 5*a* and 5*b* of the harness and to rotate the connector 7 in order to add an additional equipment item 9', 9" in addition to equipment item 9. The additional equipment item 9' and/or 9" cannot come into contact with the equipment item 9 as they are separated by the first and second rings 5*a* and 5*b*.

The equipment item 9 can be fitted around the rod 8 whereas the additional equipment item 9' and/or 9" can be fixed to another part of the connector 7, i.e. outside the axis of rotation of the connector 7 formed by the rod 8. The opposite configuration is also possible. As illustrated in FIG. 1, it is also possible to add a second additional equipment item 9" to the connector 7.

When the additional equipment item 9' and/or 9" is tensioned, it is easy to access the equipment item 9 as it can move easily in rotation and is blocked between the two rings 5*a* and 5*b*. Use of the connector 7 under load is thereby improved.

The rod 8 can rotate on itself in the two rings 5*a* and 5*b*. It is particularly advantageous to provide a rod 8 that is rectilinear in each of the rings 5*a* and 5*b* and advantageously rectilinear between the two rings.

In a first embodiment, the rod 8 is fitted removable from the rest of the connector which enables the rest of the connector to be separated in order to add an equipment item to it more easily. As an alternative, the rod 8 can be fitted irremovable from the rest of the connector 7 and advantageously irremovable from the first and second rings 5*a* and 5*b*.

In a second embodiment which can be combined with the previous embodiment, the rod 8 is fitted removable from at least one of the first and second rings 5*a* and 5*b* which makes use of the connector 7 easier.

If the connector 7 is fitted removable with respect to the rings 5*a* and 5*b*, it is particularly advantageous to provide for the rings 5*a* and 5*b* to be fitted in fixed manner on the connecting part and for the rod 8 to be able to be removed to fit or remove the connector 7. It is also possible to provide rings 5*a* and 5*b* fitted in fixed manner on the connecting part and a connector fitted in fixed manner in the rings 5*a* and 5*b*.

The first and second rings 5*a* and 5*b* can be of any shape. In the illustrated embodiments, the first and second rings extend perpendicularly or substantially perpendicularly to the surface of the connecting part 6. Other configurations can however be envisaged.

In the embodiments illustrated, the two rings 5*a*/5*b* present a constant thickness. The thickness is measured in the first direction.

In the embodiments illustrated, the two rings present a constant separating distance at all points, the separating distance being measured in the first direction. This configuration is particularly advantageous as it enables the two rings to be made to work in the same manner. It is even more advantageous to have two rings with the same mechanical performances, for example the two rings are made from the same material and have the same width and the same thickness. This configuration enables a better operation of the connector 7 with respect to the harness to be obtained.

To facilitate rotation of the equipment item 9 with respect to the connector 7, it is particularly advantageous to provide for the two rings 5*a* and 5*b* not to overlap. An overlap will mean an additional thickness which will result in an irregular movement of the equipment item 9 around the rod 8.

Depending on the configurations, the first and second rings 5*a* and 5*b* can advantageously be made from textile materials or from metallic materials. However there is nothing to prevent the use of other materials to form the two rings 5*a* and 5*b*.

In a particular embodiment, the first and second rings 5*a* and 5*b* are formed by textile loops. In this configuration, it is advantageous to fix the two rings 5*a* and 5*b* to a connecting part 6 which is made from textile material or from polymer material. Such an embodiment enables a ventral or lateral suspension point to be formed by fixing the first and second rings 5*a* and 5*b* to the belt 2 which advantageously forms the connecting part 6. As an alternative, the two rings 5*a*/5*b* are fixed to the connecting part 6 which is Itself fixed to the belt 2. In another embodiment, the two rings 5*a*/5*b* are fixed to the connecting part 6 which is fixed to the shoulder straps 4 so as to form a sternal suspension point or a dorsal suspension point.

In a ventral, sternal or dorsal suspension point, the first direction is parallel to the longitudinal axis of the belt 2. In conventional use, with the user standing on both feet, the first direction is horizontal. For a lateral suspension point, the first direction is perpendicular to the longitudinal axis of the belt 2. In conventional use, with the user standing on both feet, the first direction is vertical.

In a particular embodiment, the two rings 5*a* and 5*b* are formed by one or more straps which are fixed to the connecting part 6 or by one or more ropes which are fixed to the connecting part 6. When the loops 5*a* and 5*b* are formed by flexible parts, a certain comfort is procured when tensioning the harness 1 as there is no hard point on the connecting part 6.

In certain embodiments, the rod 8 can also move with respect to the connecting part 6 by moving inside the two rings 5*a* and 5*b*. As an alternative, the rod 8 is fixed in position in the two rings 5*a* and 5*b* and only a rotation is possible with possibly a translational movement in the first direction.

In another embodiment which can be combined with the previous embodiment, the rod 8 can also move with respect to the connecting part 6 when movement of the two rings 5*a* and 5*b* takes place when the latter can be deformed. Movement of the rod 8 can take place along the longitudinal axis of the connecting part 6 and/or perpendicularly to the longitudinal axis of the connecting part 6.

Figure 5:
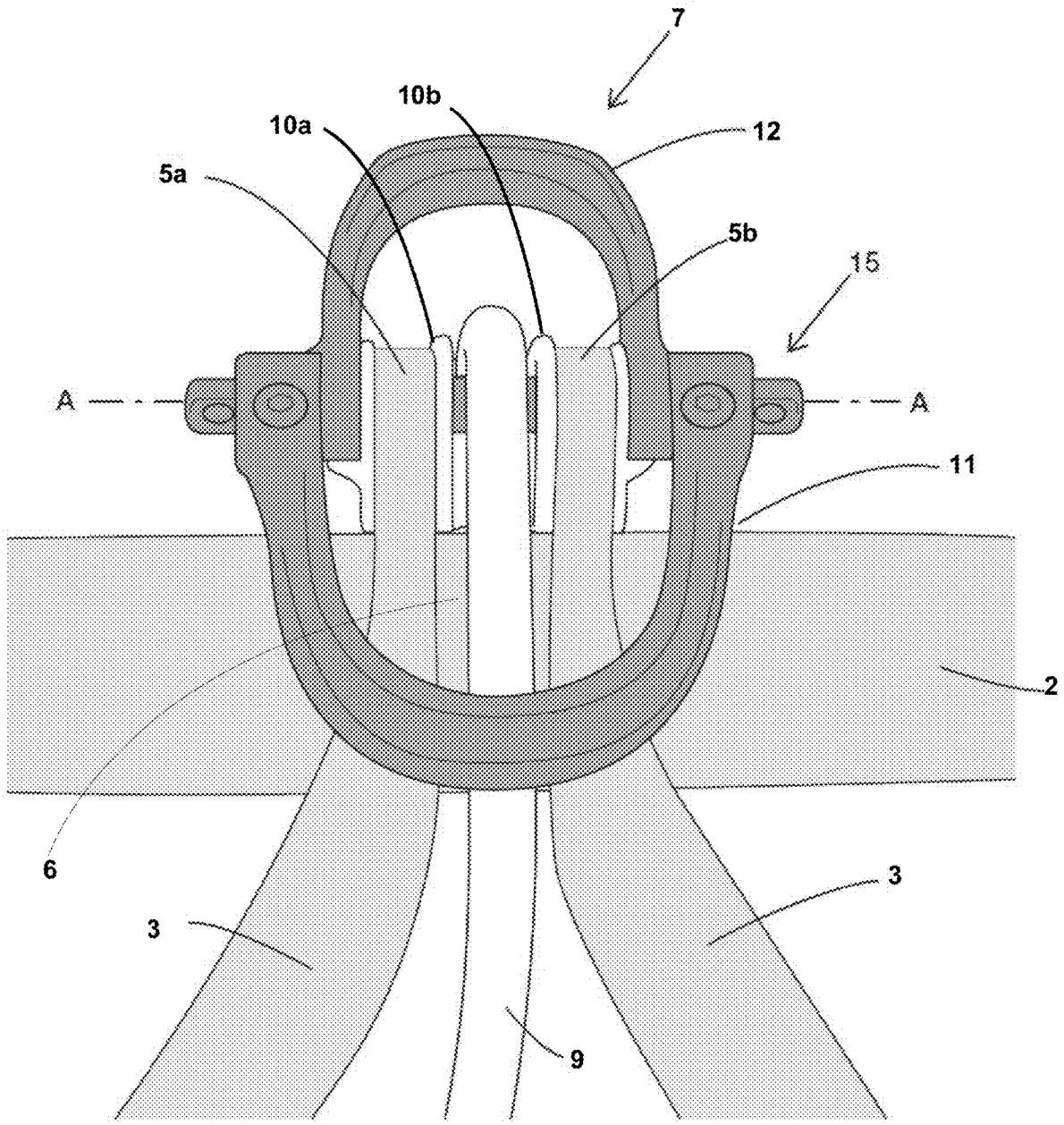
FIG. 5 represents, in schematic manner, a front view of a roping harness provided with a ventral suspension point according to the invention.
Figure 6:
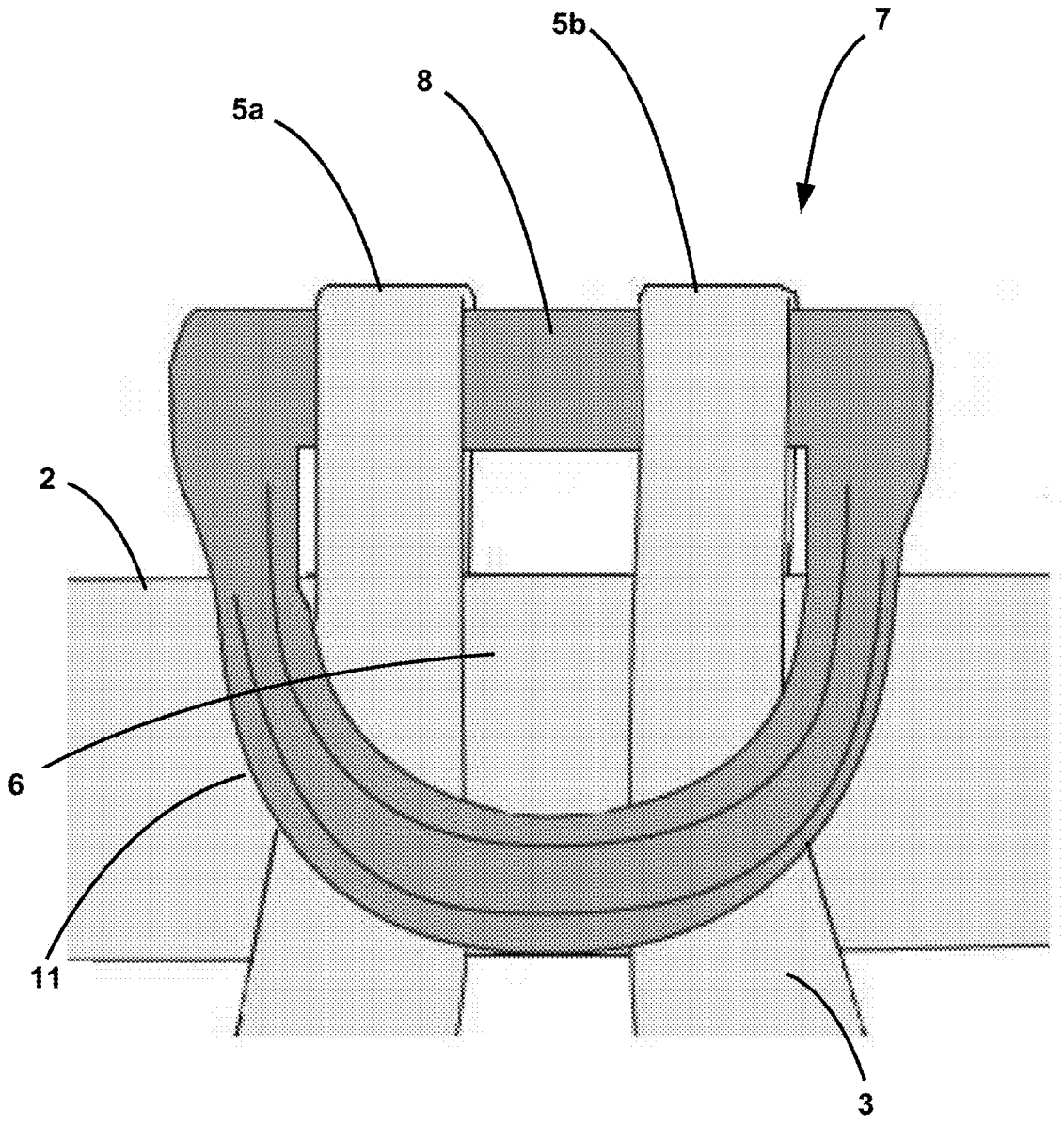
FIGS. 6 and 7 represent schematic views of two other embodiments of a roping harness provided with a ventral suspension point according to the invention.
Figure 7:
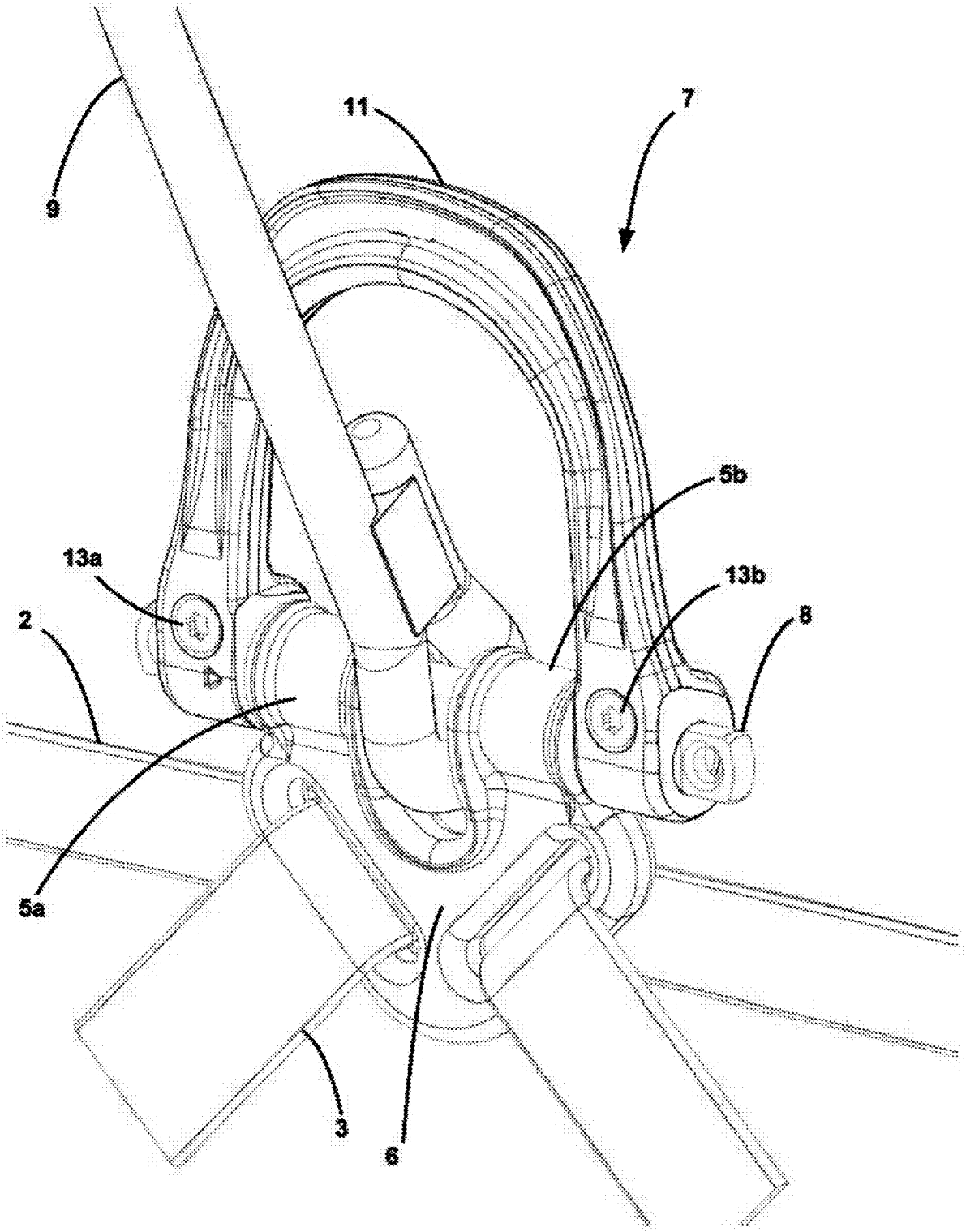

In a particularly advantageous embodiment that is illustrated in FIG. 5, the first ring 5*a* is associated with a first adapter 10*a*. The first ring 5*a* surrounds the first adapter 10*a* which defines an opening for passage of the rod 8. The passage opening is configured to impose the position of the rod 8 of the connector 7 inside the first ring 5*a* and the position of the connector 7 with respect to the belt 2. In preferential manner, the first adapter 10*a* tensions the first ring 5*a* defining its shape, i.e. its opening allowing passage of the rod 8. The adapter 10*a* is advantageously configured to prevent movement of the rod 8 perpendicularly to the first direction which facilitates use of the connector 7 under load.

In particularly advantageous manner, the second ring 5*b* also surrounds a second adapter 10*b* defining a passage opening which is configured to impose the position of the rod 8 of the connector 7 inside the second ring 5*b*. The adapter 10*b* is advantageously configured to prevent movement of the rod 8 perpendicularly to the first direction which facilitates use of the connector 7 under load.

By means of the adapters 10*a* and 10*b*, rotation of the connector 7 inside the rings 5*a* and 5*b* can take place without direct contact with the materials forming the loops which prevents premature wear of the two rings 5*a* and 5*b*. In preferential manner, the second adapter 10*b* tensions the ring 5*b* defining its shape, i.e. its opening allowing passage of the rod 8.

It is particularly advantageous to provide for the first adapter 10*a* and second adapter 10*b* to form part of a single monolithic part. In this way, the two openings defined by the first and second adapters 10*a* and 10*b* are mechanically secured to one another enabling a better movement of the connector 7 with respect to the belt 2 and better work of the two rings 5*a* and 5*b* when they are stressed. The two openings are advantageously aligned in order to enable the rod 8 to be inserted in the two openings without forcing. This embodiment reduces the risks of incorrect insertion of the rod 8 of the connector 7 in one of the rings 5*a*/5*b* only. It is then possible to reduce the size of the loops in order to limit the space occupation and dimension of the connector 7. The two adapters 10*a* and 10*b* better define the position of the two loops at all points.

In a preferential embodiment, the first adapter 10*a*, the second adapter 10*b* or both the adapters are configured to collaborate with the connector 7 to prevent it from rotating beyond a threshold position and to prevent the connector 7 from coming into contact with the user's abdomen for a ventral suspension point or another part of the body for a lateral, sternal or dorsal suspension point.

In an advantageous embodiment, the first adapter 10*a* and/or second adapter 10*b* comprises a stop which is arranged to come into contact with the connector 7 when the latter reaches a threshold value.

The connector 7 defines a ring, for example a D-shaped ring, and comprises two sections which are secant to the axis of rotation of the rod 8. It is particularly advantageous for the first adapter 10*a* and/or second adapter 10*b* to form a stop which comes into contact with at least one of these sections to prevent the connector 7 from overshooting the threshold position. In other words, the stop is advantageously configured to prevent the connector 7 from moving too close to the user's body, i.e. from rotating so that it is facing in the direction of the user's head, or his shoulders, or more particularly the user's spinal column for a ventral or sternal suspension point.

In this way, the adapter 10*a*/10*b* does not hinder rotation of the connector 7 with respect to the belt 2 until the connector 7 comes up against the stop formed by the adapter 10*a*/10*b*. At this moment, movement of the connector 7 may be possible by moving the rings 5*a* and 5*b* with respect to the belt 2.

In particularly advantageous manner, the outer section of the adapter 10*a*/10*b* comprises anti-rotation means which are configured to prevent rotation of the adapter 10*a*/10*b* with respect to the ring 5*a*/5*b*. The outer section of the adapter 10*a*/10*b* is defined by the outer wall of the adapter which comes into contact with the inner wall of the ring 5*a*/5*b*.

The anti-rotation means prevent rotations of the adapters 10*a*/10*b* with respect to the rings 5*a*/5*b* when the connector 7 comes up against the stop formed by the adapter. This for example enables user discomfort to be limited when the adapter presses on the belt 2. The anti-rotation means can be achieved in any suitable manner, for example by fixing the adapter 10*a*/10*b* on the ring 5*a*/5*b* and in particular by stitching. However it is possible to provide for the adapter 10*a*/10*b* not to have an axis of symmetry parallel to or coinciding with the axis of rotation of the connector 7 so that rotation of the adapter is difficult or even impossible. In the illustrated embodiment, the cross-section of the adapter is maximum in the region receiving the rod 8 and minimum in the region in immediate proximity to the belt 2.

The adapter 10*a*/10*b* can be made from any suitable material. In advantageous manner, the adapter is made from unbreakable plastic material, for example polyamide or polypropylene. However, it is advantageous to manufacture the adapter 10*a*/10*b* using a polymer material as the adapter is not subjected to any strong mechanical stress. The resistance when the user is suspended in the harness 1 is provided by the first and second rings 5*a*/5*b* made from textile elements. Manufacturing the adapter 10*a*/10*b* from polymer material enables the weight of the adapter to be reduced while at the same time ensuring the required functionality. The use of a polymer material also enables the adapter to be manufactured simply, without any risk of weakening the associated loop. Rotation of the rod 8 can be performed without any risk of weakening of the rod 8 and without any risk of weakening of the rings 5*a*/5*b*.

In advantageous manner, the first and second rings 5*a* and 5*b* are fitted movable with respect to the belt 2 and preferentially movable in rotation. It is particularly advantageous to provide for the axis of rotation of the first and second rings 5*a* and 5*b* to be parallel or substantially parallel to the axis of rotation of the rod 8.

Figure 2:
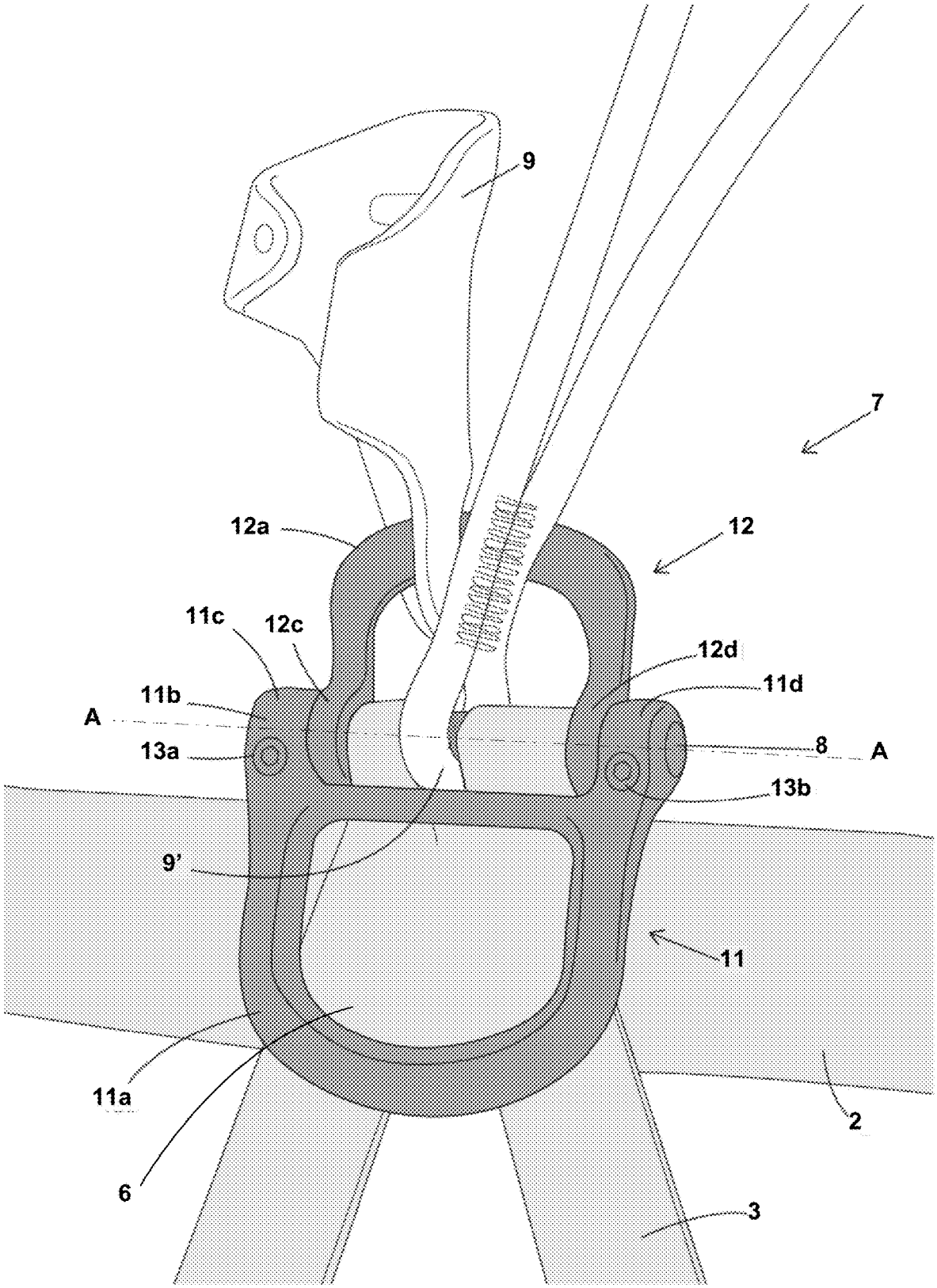
FIG. 2 represents a schematic view of a roping harness provided with a ventral suspension point according to a second embodiment of the invention.
Figure 3:
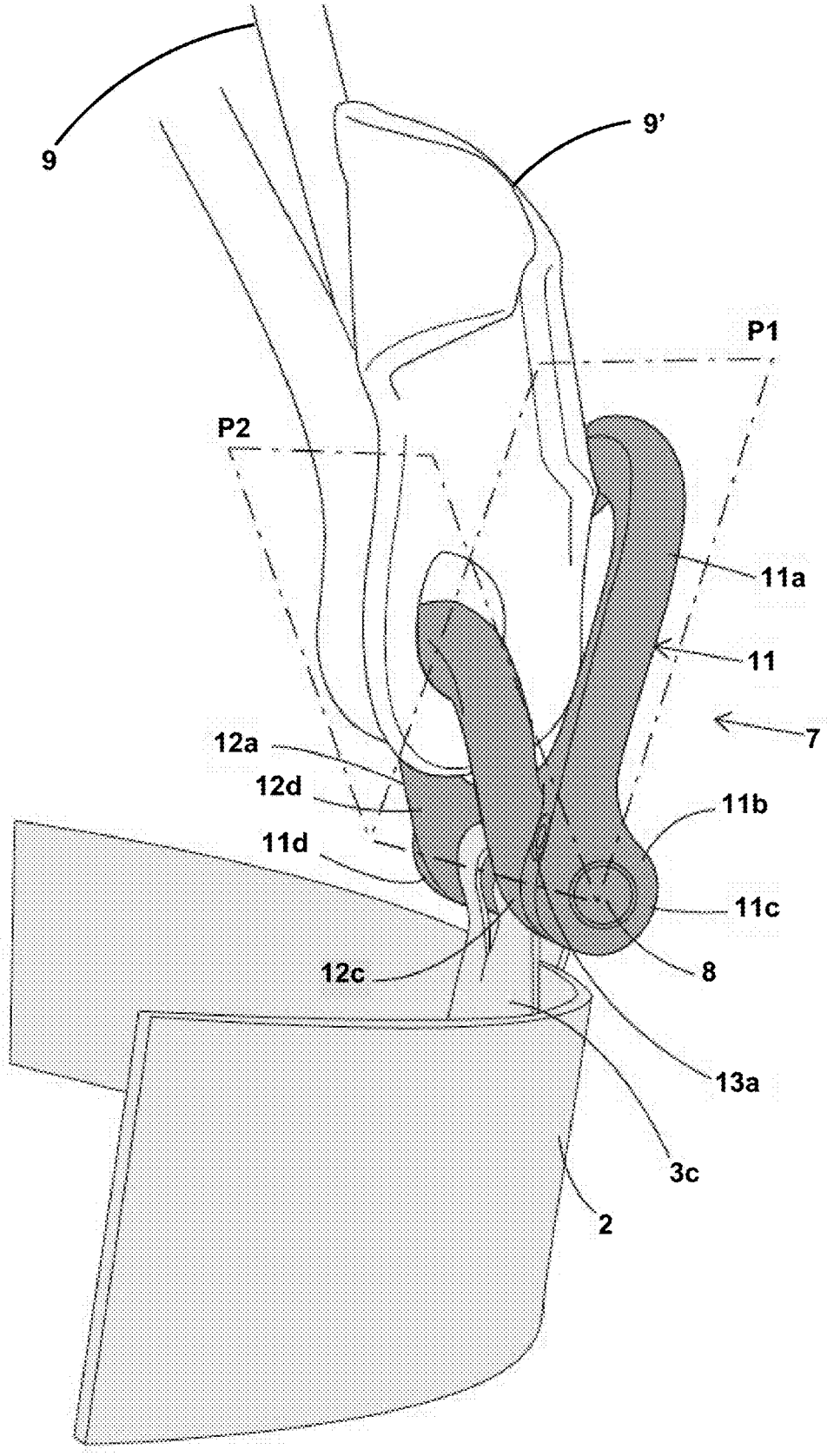
FIG. 3 represents another schematic view of a roping harness provided with a ventral suspension point according to the second embodiment of the invention.

In a particular embodiment illustrated in FIGS. 1, 2 and 3 in relation with a ventral suspension point, the first and second rings are formed by a textile part which passes on each side of the connecting part 6, here on each side of the belt 2, and which forms a loop. By forming a ring of textile material, it is possible to make a solid mechanical connection having a low weight. The connection is flexible which provides a certain user comfort. It is also apparent that a textile connection is simple to achieve and represents hardly any extra cost. As an alternative, the rings 5*a* and 5*b* can be formed by two pieces of the textile part arranged on one and the same side of the connecting part, here of the belt 2, and preferably on the outer surface of the belt 2 to limit the risks of discomfort.

It is possible to use such an embodiment to form a sternal or dorsal suspension point using a textile part which passes on each side of the connecting part 6, or on one side only of the connecting part 6 and preferably on the external side.

It is particularly advantageous to provide for the two rings to extend beyond the connecting part 6 and in particular beyond the belt 2 in order to reduce the stress forces applied on the belt 2 which may cause hard points resulting in problems of user discomfort.

In the case of a ventral suspension point, it is advantageous to provide for the first and second rings 5*a*/5*b* to be formed by textile parts which also serve the purpose of forming the first and second leg loops 3. In this way, the stress forces are better distributed and manufacturing of the harness 1 is easier to perform.

When the adapter 10*a*/10*b* is used and when the rod 8 of the connector 7 is located at a distance from the belt 2, it is advantageous to provide for the adapter 10*a*/10*b* to define a placing groove of the equipment item 9. This groove is advantageously configured for the equipment item 9 not to come into direct contact with the user and for example with the user's abdomen. This precaution makes for improved use of the equipment item 9 and prevents premature wear of the equipment item 9 or of the user's clothing each time the equipment item 9 is made to rotate around the rod 8. The groove is arranged between the rings 5*a* and 5*b* and its inner wall can be defined by the adapter and/or the connecting part 6.

As an alternative, the adapter can be configured to enclose the rod 8 between the two rings 5*a*/5*b*. The equipment item 9 then rotates around the rod 8 in contact with the adapter 10.

In another embodiment, the first and second rings 5*a* and 5*b* are formed by metal rings.

In the same way as for the rings made from textile, it is possible to use an adapter 10*a*/10*b* such as the one described in the foregoing.

In another embodiment, the first and second rings 5*a*/5*b* and the connecting part 6 are formed by a metal part which is advantageously a monolithic part that cannot be dismantled. The two rings 5*a*/5*b* and the connecting part 6 form part of a single component which defines the two rings 5*a*/5*b* and connecting part 6. In this configuration, the two rings are fixed with respect to one another in all directions. This configuration is particularly advantageous as it is easier to achieve and circumvents the need for additional fixing systems which involves additional technological steps which may be costly and observation points to be monitored to assess the wear of the harness.

This metal part advantageously comprises one or more slots to enable it to be fixed to the harness by means of one or more straps. In the embodiment illustrated in FIG. 7, the connecting part comprises two inclined slots which are configured to divert first and second straps forming the belt 2 in order to initiate first and second leg loops 3. The harness 1 comprises first and second rings 5*a* and 5*b* which are positioned on the belt 2, preferably on the ventral part of the belt 2. The ventral suspension point enables the strap forming the belt 2 to be diverted to form at least one leg loop 3.

Such a connecting part 6 can however also be used to connect the rings 5*a* and 5*b* and the connector 7 with the shoulder straps of the harness and to define a sternal or dorsal suspension point.

It is further possible to use such an embodiment to form a lateral suspension point.

It is particularly advantageous to provide for the first and second rings 5*a* and 5*b* to be loops oriented perpendicularly to the longitudinal axis of the belt 2 to form a ventral suspension point, i.e. for the rings 5*a* and 5*b* to extend in a direction perpendicular to the longitudinal axis of the belt 2. As an alternative, the first and second rings 5*a* and 5*b* can deviate from the perpendicular direction. Under traction, the two rings tends to move with respect to the harness which makes rotation of the connector more difficult. The deviation from the perpendicular direction is advantageously equal to 45°. In this exemplary case, the rings move along the longitudinal axis when the connector 7 is tensioned. In this way, the axis of rotation of the connector 7 can rotate inside the two loops 5*a*/5*b* in order to allow movement of the connector 7 in rotation with respect to the belt 2 of the harness.

What is meant by equipment item 9 or additional equipment item 9' and/or 9" is for example a lanyard with or without energy absorber, a mobile fall arrester, a self-braking descender, a rope clamp, a rope, a strap, a carabiner, a quick link, a shackle and/or a swivel and in general manner any metal connector which can be opened. However, it is particularly advantageous to provide for the equipment item 9 to be a strap or a rope performing the function of a lanyard with or without energy absorber. The additional equipment item 9' and/or 9" is advantageously a mobile fall arrester, a self-braking descender, a rope clamp, a rope, a strap, a a carabiner, a quick link, a shackle and/or a swivel. It is possible to fit several additional equipment items 9', 9" in the connector 7.

Depending on the embodiments, the loop of the equipment item 9 surrounding the rod 8 can be a fixed loop.

It is possible to provide for the equipment item 9 or additional equipment item 9' and/or 9" to comprise a metal loop which cannot be opened. It is then necessary to provide for the connector 7 to be able to be opened, for example to be removed, in order to enable assembly and disassembly of the connector 7 and insertion of the equipment item 9 and/or additional equipment item 9' and/or 9" between the two rings 5*a* and 5*b* and around the rod 8 of the connector 7 and/or in the ring defined by the connector 7.

For example purposes, a rope climbing accessory such as a descender or an ascender can be attached inside the connector 7 to support the user in the course of his professional or sporting activity.

As indicated in the foregoing, several embodiments of the connector 7 can be envisaged. The connector 7 can have any shape which forms a closed contour. In a particular exemplary case, the rod 8 enables the contour to be closed. In this case, this enables a rope climbing accessory to be fixed in the connector 7 without having to use an intermediate connection part. As an alternative, the connector 7 can define a closed contour which is not defined by means of the rod 8. The rod 8 is then located away from the closed contour.

The rod 8 can be monolithic with the rest of the connector 7. This makes manufacture of the connector 7 easier and the risks of handling errors are reduced. As an alternative, the rod 8 can be able to be dismantled from the rest of the connector 7.

The rod 8 and the rest of the connector 7 can be movable with respect to one another. In particular, the connector 7 can move in rotation without causing rotation of the rod 8. The opposite can also be true. The connector 7 can be movable in rotation around the rod 8 of longitudinal axis AA. As a variant, the connector 7 can be fixed to the rod 8 and the assembly can be movable in rotation with respect to the harness.

In a particularly advantageous embodiment that is illustrated in the different figures, the connector 7 comprises a first part 11 defining a closed contour or an open contour. The first part 11 is fitted movable in rotation with respect to the harness 1 around the axis AA of the rod 8 as illustrated in FIGS. 1, 2, 3, 4 and 5. The connector 7 also comprises a second part 12 defining a closed contour or an open contour and fitted movable in rotation around a second axis parallel to the axis AA. The second part 12 is fitted movable in rotation with respect to the first part 11 around the second axis.

In advantageous manner, the first part 11 defines an open contour and is C-shaped. By separating the first part 11 from the rod 8, it is thus possible to insert an additional equipment item 9' and/or 9" in the first part when the additional equipment item 9' and/or 9" Is provided with an opening allowing the first part 11 to be inserted. The same can advantageously be true for the second part 12.

What is meant by C-shaped is that the first part 11 and/or second part 12 do not define a closed contour and that it is possible to place a rope climbing accessory on the first part 11 and on the second part 12 without having recourse to a carabiner or a quick link. The closed contour is achieved in collaboration with the associated rotation rod.

The first part 11 and/or second part 12 can quite easily be U-shaped, M-shaped, V-shaped, or W-shaped, or be of any shape that is not a closed contour. However, once the first and second parts 11 and 12 have been fitted in the connector 7, two closed contours are formed by means of the first and second parts 11 and 12 and the associated fixing rod, for example the rod 8 in the figures.

As an alternative, the first part 11 and/or second part 12 each define a closed contour without the requiring the fixing rod. However it is particularly advantageous to provide for at least the first part 11 or second part 12 to define an open contour in order to facilitate connection of the equipment items and use of the latter in the connector 7.

The connector 7 is arranged on the harness 1 in such a way that the first part 11 is configured to be placed against the belt 2 or the user in the direction of the pair of leg loops 3, whereas the second part 12 is configured to be placed against the belt 2 or the user in the direction of the pair of shoulder straps 4. The positions of the first and second parts 11 and 12 can however be reversed without modifying the general operation of the harness 1.

According to a first embodiment, the second axis of rotation of the second part 12 can be different from the axis of rotation AA of the first part 11. This means for example that the connector 7 can comprise an additional rod (not shown), which can be detached from the first and second parts 11 and 12 in order to fit a rope climbing accessory on the second part 12. This embodiment is however less advantageous as the overall dimensions of the connector 7 are larger than those of a single pin 7 which simultaneously connects the first part 11 with the belt 2 and the second part 12.

In advantageous manner, when the first part 11 defines a closed contour, the rod 8 defines an additional hole with the outer edge of this closed contour used to collaborate with the additional equipment items 9. The first and second rings 5*a* and 5*b* can pass through the additional hole without passing through the closed contour used for the additional equipment items 9. The closed contour of the connector 7 protects the first and second rings 5*a* and 5*b* against possible impacts caused by the additional equipment items 9 in the connection ring. This precaution enables the lifetime of the first and second rings 5*a* and 5*b* to be extended.

According to the embodiment illustrated in FIGS. 1 to 5 and described hereinafter, the second axis of rotation coincides with the longitudinal axis AA, which means that the second part 12 is fitted movable in rotation with respect to the belt 2 around the rod 8.

For the connector 7 to be as functional as possible, it is advantageous to use first and second parts 11 and 12 having specific three-dimensional shapes.

The first part 11 can be a flat part, i.e. the extreme peripheral region of the part 11 is contained in one plane and/or the internal peripheral region of the closed contour defined in the first part 11 is contained in one plane. Connectors of the prior art are curved outwards at the level of the distal part which can be uncomfortable for the user as the curved part can come into contact with the abdomen.

It is advantageous to keep a flat connection ring and to offset the axis AA from this plane. The axis AA can advantageously be offset against the user's body when the first part 11 is directed towards the side where the leg loops 3 are located, i.e. the part farthest away from the axis of rotation.

In other words, the edge of the closed contour defining the connection ring of the first part 11 is contained in a first flat region of the first part 11 so as to define a first plane P1. The rod 8 can advantageously be eccentric with respect to this first plane P1 (cf. FIG. 3).

The first and second parts 11 and 12 are movable in rotation around the rod 8. It is particularly advantageous to provide for the fixing regions of the first part 11 with the rod 8 to be separated by the two fixing regions of the second part 12 with the rod 8 as is represented in FIGS. 1 to 5. It is particularly advantageous to provide for the second part 12 to be narrower than the first part 11 in the direction of the longitudinal axis of the rod 8.

As an alternative, it is also possible to provide for the fixing regions of the second part 12 with the rod 8 to be separated by the fixing regions of the first part 11 with the rod 8. An alternation between the fixing regions of the first and second parts 11 and 12 along the rod 8 is preferably to be avoided as the stresses in the first and second parts 11 and 12 are less well distributed when the two parts are folded onto one another.

The embodiment illustrated in the figures is nevertheless preferred as it enables folding of the first part 11 on the second part 12 to be limited.

According to the preferred embodiment illustrated in FIGS. 1 to 5, the first part 11 comprises a first jointed region 11*b* connecting the connection ring 11*a* with the rod 8. In side view, the first part 11 can be L-shaped and be connected to the rod 8 at the level of one of the ends of the L. The connection ring 11*a* defining the closed loop is therefore a flat region and corresponds to a branch of the L, whereas the other branch of the L is comprised in the first jointed region 11*b*. The first plane P1 can correspond to any plane passing inside the first part 11 and parallel to the edges of the connection ring 11*a*.

Thus, when a vertical force is applied in the connection ring 11*a*, the distal part of the first part 11 is slightly offset from the user's abdomen which prevents any inconvenience.

In the same way, it may be advantageous to reproduce this particular shape with the second part 12. The axis AA is advantageously offset against the belt 2 when the C-shaped part is directed towards the user's shoulders.

The C-shaped distal part of the second part 12 is contained in a second flat region 12*a* of the part so as to define a second plane P2. The rod 8 can advantageously be eccentric with respect to this second plane P2.

Given that the second part 12 is movable in rotation around the rod 8, this results in the second part 12 being able to comprise a second jointed region 12*b* connecting the closed contour to the rod 8. In a cross-sectional plane perpendicular to the longitudinal axis of the rod 8, the second part 12 can be L-shaped and be connected to the rod 8 at the level of one of the ends of the L. The second flat region 12*a* therefore corresponds to one branch of the L, whereas the other branch of the L is comprised in the second jointed region 12*b*. The second plane P2 can correspond to any plane passing inside the second part 12 and parallel to the edges of the second flat region 12*a*.

As indicated in the foregoing, to facilitate fitting of the different parts composing the connector 7, one of the parts can be larger than the other in the direction of the axis AA so as to surround the smaller part. For example, the first part 11 can surround the second part 12 at the level of the axis AA.

For this, the first part 11 can comprise first and second attachment means 11*c* and 11*d* located in the fixing regions of the first part and configured to allow passage of the rod 8. The first and second attachment means 11*c* and 11*d* are advantageously separated by a first distance L1 in the direction of the axis AA. The second part 12 can also comprise third and fourth attachment means 12*c* and 12*d* located in the fixing regions of the second part and configured to allow passage of the rod 8. The third and fourth attachment means 12*c* and 12*d* are advantageously separated by a second distance L2 in the direction of the axis AA which is smaller than the distance L1. In this way, the third and fourth attachment means 12*c* and 12*d* are advantageously located between the first and second attachment means 11*c* and 11*d*. This means that the first part 11 surrounds the second part 12.

The attachment means can for example be annular parts or clips and advantageously have a slightly larger cross-section than the diameter of the rod 8 so as to facilitate rotation of the first and second parts 11 and 12 on the rod 8. What is meant by slightly larger is that the diameter of the annular parts or clips is about 0.1 mm larger than the diameter of the rod 8.

Structurally, it is preferable for the first and second parts 11 and 12 to be assembled without any functional clearance in the direction AA so that the parts cannot translate with respect to one another. The first and second parts 11 and 12 can therefore only be movable in rotation with respect to one another.

Figure 4:
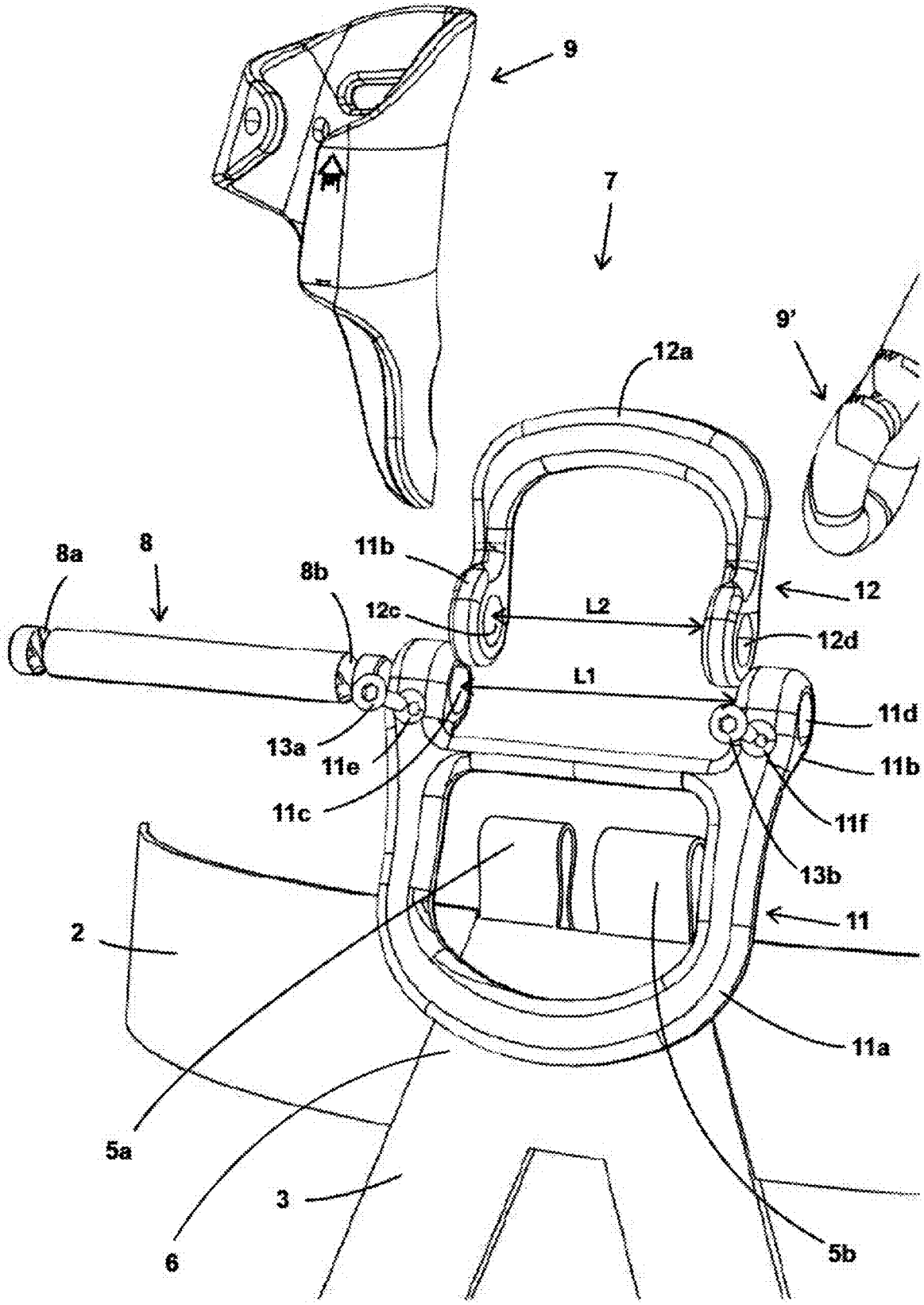
FIG. 4 represents an exploded schematic view of a ventral suspension point of a roping harness according to the invention.

To prevent any lateral movement of the first and second parts 11 and 12 along the rod 8, the latter can comprise first and second recesses 8*a* and 8*b* which collaborate with retaining pins 13*a* and 13*b* which are inserted in the connector 7 (cf. FIG. 4).

The first and second retaining pins 13*a* and 13*b* are advantageously of tubular or cylindrical shape and can for example be screws, rivets, or nails. The width of the first and second recesses 8*a* and 8*b* along the axis AA is slightly larger than the diameter of the first and second retaining pins 13*a* and 13*b* so that the fixing means can be inserted in the recesses 8*a* and 8*b*.

According to the embodiment illustrated in the figures, the first and second retaining pins 13*a* and 13*b* are inserted in first and second holes 11*e* and 11*f* of the first part. As an alternative, the first and second holes could be located on the second part 12. A combination of these embodiments is also possible with possibly a larger number of retaining pins, for example 2, 3 or 4.

In so far as the first and second parts 11 and 12 are fitted without any functional clearance in the direction AA, it is also possible to provide a rod 8 comprising a single recess 8*a* configured to collaborate with a single retaining pin 13*a* placed in a single hole positioned indifferently on the first part 11 or on the second part 12.

The position of the first and second holes 11*e* and 11 *f* can be chosen so that the axes of the first and second retaining pins 13*a* and 13*b* are secant or not with the axis AA. If the axes of the first and second retaining pins 13*a* and 13*b* are secant with the axis AA, their ends are placed in the recesses but not necessarily pressing against the bottom of the latter. On the other hand, if the axes of the first and second retaining pins 13*a* and 13*b* are not secant with the axis AA, the latter are then tangent with the rod 8 at the level of the recesses 8*a* and 8*b* so as to allow rotation of the parts 11 and 12 along the axis AA, but not translation of the latter.

In the particular embodiment illustrated in the figures, the first and second holes 11*e* and 11*f* open onto the attachment means 12*c* and 12*d* and are tangent to the rod 8 at the level of the first and second recesses 8*a* and 8*b*. This has the effect of preventing translational movements of the first and second parts 11 and 12 when they are fitted without functional clearance with respect to one another.

Fitting of the first and second parts 11 and 12 on the rod 8 can be performed in two different manners. The more advantageous manner consists in superposing the first and second flat regions 11*a* and 12*a* when the first and second parts 11 and 12 are folded onto one another. It should however be noted that the jointed shape of the first and second parts 11 and 12 can prevent them from being folded completely onto one another. The edge of the connection ring 11*a* located 2*o* near the pin 7 comes up against the stop formed by the edge of the C-shaped region 12*a*. The first part 11 and/or second part 12 can comprise a stop which prevents rotation of the first part 11 with respect to the second part 12 beyond a threshold value.

The value of the offset between the planes P1 and P2 and the axis AA and the thicknesses of the first and second parts are chosen such that the angle formed between the two parts is sufficient to leave the equipment units fitted on one or the other of the parts 11 and 12 a certain mobility. Progression on the rope is thereby facilitated as the movements of the latter are not hampered by the connecting parts used by the user.

This configuration where the first and second parts are folded onto one another arises for example when the climber uses a descender attached to the first part 11. Use of the descender has the effect of making the first part 11 swivel towards the pair of shoulder straps 4.

However, to guarantee user comfort, the angle formed between the first and second parts 11 and 12 when they are folded onto one another has to be sufficiently small not to inconvenience the user. If the first and second parts 11 and 12 are too far apart from one another, the second part 12 could in fact exert a pressure on the user causing discomfort for the latter.

On account of the characteristic dimensions of the connector 7 and those of the rope climbing accessories, the first and second parts 11 and 12 can advantageously be separated by an arc length comprised between 0.5 and 3 cm, the arc length being measured with respect to the point situated farthest from the axis AA.

For example, if the first part 11 is larger than the second part 12, the arc length is measured between the first part and the end of the second part which is opposite the axis AA. On the contrary, if the first part 11 is smaller than the second part 12, the arc length is measured between the second part and the end of the first part which is opposite the axis AA.

To fit a connector 7 on a harness 1 such as the one which has just been described, it is first of all necessary to attach at least one rope climbing accessory to the second part 12 or the first part 11. This enables the number of carabiners or quick links attached to the connector 7 to be limited, thereby facilitating use of the latter due to the smaller size. An equipment item 9 is also fitted on the rod 8 between the two rings 5*a* and 5*b*.

The first part 11, the second part 12 and first and second rings 5*a*/5*b* are connected by means of the rod 8 so that the first and second rings are positioned between the rod 8 and the connection ring 11*a*. The connector 7 is then positioned on the ventral part of the belt 2 so as to be able to be used for the purposes of climbing on a rope.

According to the particular embodiment illustrated in FIG. 4, the rod 8 is first of all inserted in the first attachment means 11*c* of the first part 11 and then in the third attachment means 12*c* of the second part 12. The rod 8 is then inserted in the first ring 5*a*, the equipment unit 9 and second ring 5*b*. The rod 8 finally passes through the fourth attachment means 12*d* of the second part 12 and the second attachment means 11*d* of the first part 11. The retaining pins 13*a* and 13*b* are used to prevent any translation of the first and second parts 11 and 12 along the rod 8.

After assembly, it is for example possible to attach a descender on the first part 11 by means of a carabiner or a quick link. This makes it possible to alternate easily between use of the ascender placed on the second part 12 and use of the descender placed on the first part 11. If an ascender and a descender are positioned in this way on the connector 7, it is then preferable for the first part 11 to be positioned in the direction of the pair of leg loops 3 and for the second part 12 to be positioned in the direction of the pair of shoulder straps 4. This configuration is optimal in terms of user comfort, the latter not being inconvenienced by the connector 7 during his progression on the rope.

Figure 11:
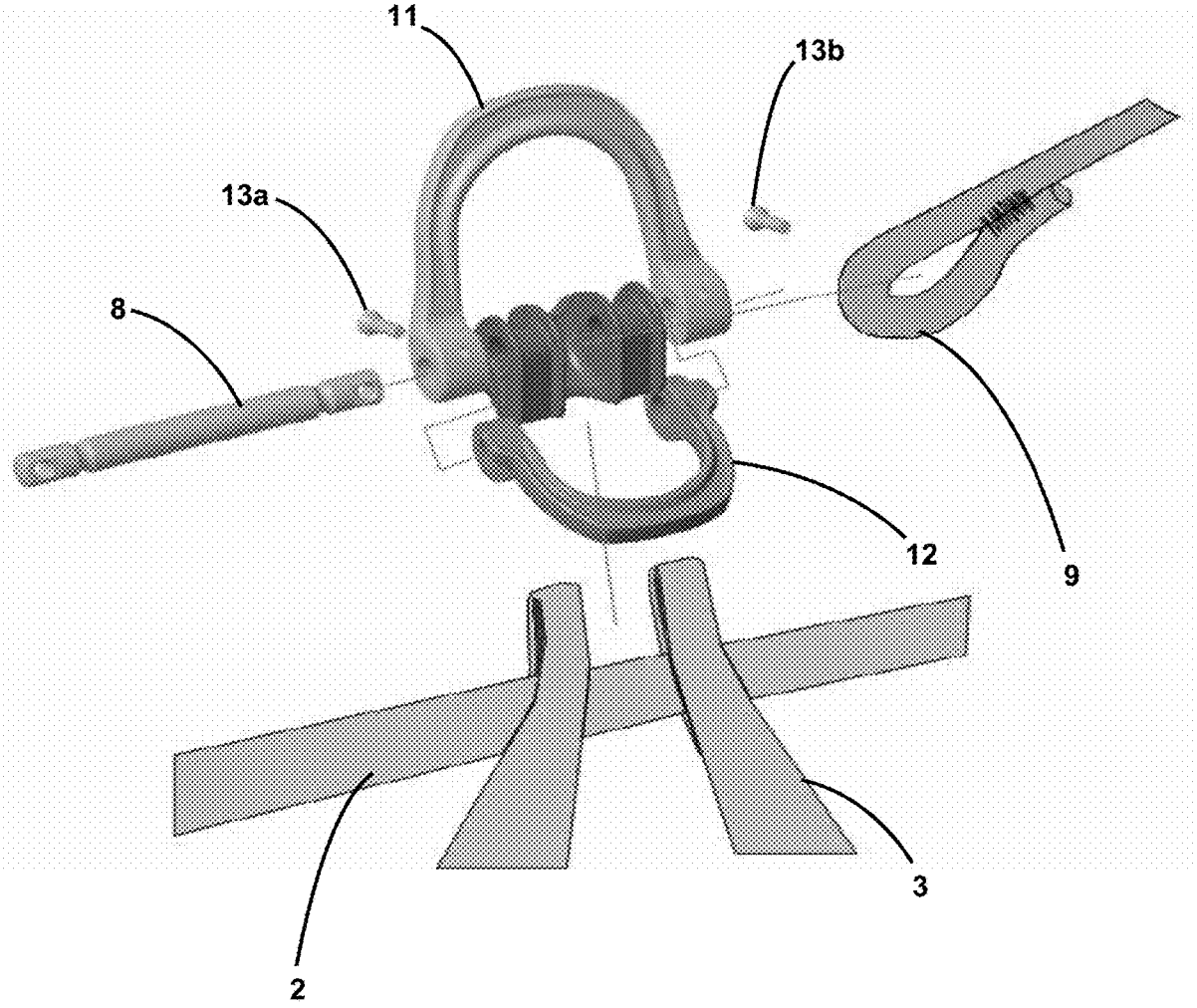
FIG. 11 represents, in schematic manner, fitting or removal of a ventral suspension point provided with an adapter.

FIG. 11 illustrates assembly of the ventral suspension point with an adapter 10*a*/10*b*. The harness comprises first and second rings made from textile, formed here by two straps. Firstly, the adapter 10*a*/10*b* is fitted inside the two rings 5*a*/5*b*. The first part 11 and/or second part 12 are then fitted outside the adapter 10*a*/10*b*. The rod 8 is then fitted inside the pass-through holes defined in the adapter 10*a*/10*b*, in the first and second rings and in the first and second parts 11 and 12, so that all these components can rotate with respect to the longitudinal axis of the rod 8.

In the illustrated embodiment, the rod 8 is blocked by means of the retaining pins 13*a* and 13*b* in order to secure all the component parts with the harness, here with the belt of the harness. As illustrated, when the rod is fitted, it is possible to insert an equipment unit 9 in the space defined by the adapter 10*a*/10*b* so that the rod 8 passes through the equipment unit 9. In this configuration, the equipment unit 9 is securedly attached to the rod 8 and is blocked by the two inner sidewalls of the adapter 10*a*/10*b*.

Although FIG. 11 illustrates assembly with a ventral suspension point, an identical assembly can be obtained for a lateral, sternal or dorsal suspension point.

The invention claimed is:

1. Roping harness comprising:

a pair of leg loops, a suspension point comprising:

distinct first and second rings separated from one another by a first distance in a first direction and defining an empty space between a first lateral surface of the first ring and a second lateral surface of the second ring, a connecting part fixed continuously to the distinct first and second rings, the connecting part mechanically connecting the distinct first and second rings with the pair of leg loops, a closed metal connector provided with a rod and a first part mounted removable from the rod, the closed metal connector and the connecting part are different of possible closing means of the roping harness, the first part and the rod defining a closed ring, the first part connecting the rod in first and second connecting points separated by the first and second rings, wherein the distinct first and second rings are arranged in such a way as to allow fitting of the rod of the closed metal connector in the distinct first and second rings, the rod presenting a longitudinal axis coinciding with the first direction, the rod being fitted movable in rotation in the first and second rings and the closed metal connector being fitted movable in rotation around the longitudinal axis of the rod, the first part rotating around the longitudinal axis of the rod, a first adapter is fitted inside the first ring, the first adapter comprising a first pass-through hole in the first direction, the rod passing through said first pass-through hole, a second adapter is fitted inside the second ring, the second adapter comprising a second pass-through hole in the first direction so that the rod passes through the first and second pass-through holes, and the first adapter is configured to prevent rotation of the first adapter with respect to the first ring around the longitudinal axis of the rod wherein an equipment item is fixed to the rod between the first and second ring, the equipment item defining a hole, the rod passing through said hole.

2. Roping harness according to claim 1, wherein the distinct first and second rings are formed by first and second textile loops and wherein the connecting part is made from textile material.

3. Roping harness according to claim 2, wherein the first and second textile loops are sewn onto the connecting part.

4. Roping harness according to claim 2, wherein the first and second textile loops are sewn onto the connecting part in first and second fixing positions aligned in the first direction.

5. Roping harness according to claim 1, wherein the first adapter and the second adapter are formed by a single monolithic part configured to allow fitting of a connecting part on the rod in a space situated between the first adapter and the second adapter.

6. Roping harness according to claim 5, wherein the single monolithic part defines a groove between the first adapter and the second adapter.

7. Roping harness according to claim 1, wherein the first adapter and eventually a second adapter are made from polymer material, the second adapter being fitted inside the second ring, the second adapter comprising a second pass-through hole in the first direction so that the rod passes through the first and second pass-through holes.

8. Roping harness according to claim 1, wherein at least the first pass-through hole of the first adapter presents a complementary cross-section to the cross-section of the rod of the closed metal connector.

9. Roping harness according to claim 1, comprising a belt and wherein the connecting part is fixed to at least a part of the belt and the distinct first and second rings are arranged so that the longitudinal axis of the rod can rotate freely in a direction parallel to the longitudinal axis of the belt.

10. Roping harness according to claim 1, comprising a belt and wherein the first ring and second rings are formed by a strap and/or a rope which are fixed directly onto the belt.

11. Roping harness according to claim 9, wherein the distinct first and second rings are fixed to the ventral portion of the belt covering the user's abdomen to form a ventral suspension point.

12. Roping harness according to claim 9, wherein the distinct first and second rings are connected to the belt to form a lateral suspension point.

13. Roping harness according to claim 12, wherein the connecting part forms at least a part of the belt and the distinct first and second rings are arranged so that the longitudinal axis of the rod can rotate freely in a direction perpendicular to the longitudinal axis of the belt.

14. Roping harness according to claim 1, comprising a belt and adjustment means of the circumference of the belt, the distinct first and second rings being distinct from the adjustment means of the circumference of the belt, and the adjustment means of the circumference of the belt are located outside a surface demarcated by fixing points of the first ring with the belt and of the second ring with the belt.

15. Roping harness according to claim 1, wherein the harness is devoid of shoulder straps.

16. Roping harness according to claim 1, comprising shoulder straps and wherein the distinct first and second rings are connected to the belt without being fixed to the shoulder straps.

17. Roping harness according to claim 16, wherein the first ring and/or the second ring are formed by a strap and/or a rope which covers two opposite surfaces of the belt.

18. Roping harness according to claim 1, comprising a belt and opening and closing means of the belt located outside a surface demarcated by fixing points of the first ring with the belt and of the second ring with the belt.

19. Roping harness according to claim 1, comprising shoulder straps and wherein the distinct first and second rings are fixed to form a sternal or dorsal suspension point, the first and/or second rings being formed by at least one strap or rope mechanically connected to at least one shoulder strap.

20. Roping harness according to claim 19, wherein the first ring is formed by a first strap and the second ring is formed by a second strap different from the first strap.

21. Roping harness according to claim 9, wherein the closed metal connector defines a closed contour, the closed metal connector being fixed to the belt by means of the distinct first and second rings so as to be able to make the closed contour rotate according to an axis of rotation parallel with or perpendicular to the longitudinal axis of the belt.

22. Roping harness according to claim 1, wherein the rod of the closed metal connector is configured to rotate independently from the rest of the closed metal connector.

23. Roping harness according to claim 1, wherein the rod of the closed metal connector is fitted in removable manner so as to enable the closed metal connector to be removed from the harness.

24. Roping harness according to claim 1, wherein the rod of the closed metal connector is configured to accommodate attachment parts of a seat support, said attachment parts being arranged on the rod outside a closed contour of the closed metal connector and of the distinct first and second rings.

25. Roping harness according to claim 1, wherein the first adapter and the second adapter are formed by a monolithic part, and is fixed to the belt to form a ventral suspension point, the first direction being parallel to a longitudinal axis of the belt.

26. Roping harness according to claim 25, wherein the monolithic part is fixed to the belt to form a lateral suspension point, the first direction being perpendicular to a longitudinal axis of the belt.

27. Roping harness according to claim 25, wherein the monolithic part is fixed to a pair of shoulder straps to form a sternal or dorsal suspension point, the first direction being perpendicular to a sagittal plane of the harness.

* * * * *